US006751329B2

(12) United States Patent
Colloms et al.

(10) Patent No.: US 6,751,329 B2
(45) Date of Patent: Jun. 15, 2004

(54) LOUDSPEAKER DRIVER

(75) Inventors: Martin Colloms, London (GB); Ian David MacFarlane, Northamptonshire (GB)

(73) Assignee: New Transducers Limited, London (GB)

( * ) Notice: Subject to any disclaimer, the term of this patent is extended or adjusted under 35 U.S.C. 154(b) by 186 days.

(21) Appl. No.: 09/955,586

(22) Filed: Sep. 19, 2001

(65) Prior Publication Data

US 2002/0034314 A1 Mar. 21, 2002

Related U.S. Application Data

(60) Provisional application No. 60/234,775, filed on Sep. 25, 2000.

(30) Foreign Application Priority Data

Sep. 21, 2000 (GB) ..... 0023134

(51) Int. Cl.[7] ..... H04R 25/00

(52) U.S. Cl. ..... 381/353; 381/111; 381/162; 381/395; 381/431; 381/396; 381/161; 101/148; 101/199; 101/171

(58) Field of Search ..... 381/59, 397, 111, 381/162, 161, 385, 395, 425, 431, 152, 396, 353, 354, 426, 423; 181/150, 171, FOR 152, 163, 338, 182, 186, 353, 354, 199, 148

(56) References Cited

U.S. PATENT DOCUMENTS

| | | | | |
|---|---|---|---|---|
| 2,524,143 | A | | 10/1950 | Smith |
| 3,946,156 | A | * | 3/1976 | Budrose |
| 4,299,041 | A | | 11/1981 | Wilson |
| 4,363,081 | A | | 12/1982 | Wilbur |
| 4,425,098 | A | | 1/1984 | Doering |
| 4,611,262 | A | | 9/1986 | Galloway et al. |
| 4,926,486 | A | | 5/1990 | Barsumian |
| 6,002,779 | A | * | 12/1999 | Johnston |
| 6,160,898 | A | * | 12/2000 | Bachmann |
| 6,181,799 | B1 | | 1/2001 | Azima et al. |
| 6,192,136 | B1 | * | 2/2001 | Azima |
| 6,243,472 | B1 | * | 6/2001 | Bilan |
| 6,278,787 | B1 | * | 8/2001 | Azima |
| 6,285,770 | B1 | | 9/2001 | Azima et al. |
| 6,478,109 | B1 | * | 11/2002 | Kam |
| 6,481,173 | B1 | * | 11/2002 | Roy |

FOREIGN PATENT DOCUMENTS

| | | |
|---|---|---|
| GB | 2 268 119 A | 1/1994 |
| WO | WO 97/09842 A2 | 3/1997 |
| WO | WO 98/34320 A2 | 8/1998 |
| WO | WO 00/22877 A1 | 4/2000 |
| WO | WO 00/48428 A2 | 8/2000 |

* cited by examiner

*Primary Examiner*—Curtis Kuntz
*Assistant Examiner*—Dionne N. Harvey
(74) *Attorney, Agent, or Firm*—Foley & Lardner

(57) ABSTRACT

A drive module for attachment to a rigid panel and adapted to apply bending wave energy at audio frequencies to the panel whereby the panel can radiate an audio output. The drive module has a housing adapted to be secured to the panel, at least one foot on the housing and adapted to fix the housing securely to the panel, an electro-mechanical transducer in the housing, a support for the transducer in the housing, the transducer being adapted to contact the panel to apply bending wave energy thereto when energized with an electrical audio signal, and an audio signal amplifier in the housing.

36 Claims, 2 Drawing Sheets

LOUDSPEAKER DRIVER

This application claims the benefit of provisional application No. 60/234,775, filed Sep. 25, 2000.

TECHNICAL FIELD

The invention relates to loudspeakers and, more particularly, to loudspeaker drivers. The invention particularly relates to drivers for the class of loudspeakers known as bending wave speakers, e.g. of the kind described in WO97/09842.

BACKGROUND ART

Merchandising displays, toys and novelties are known which contain some form of sound generator that produces speech, music or other audible output associated with the display or article. See, e.g., Smith U.S. Pat. No. 2,524,143; Wilson U.S. Pat. No. 4,299,041; Wilbur U.S. Pat. No. 4,363,081; Döring U.S. Pat. No. 4,425,098; Galloway U.S. Pat. No. 4,611,262; Azima U.S. Pat. No. 6,181,799; Azima U.S. Pat. No. 6,285,770; and Yu GB 2 268 119.

SUMMARY OF THE INVENTION

It is an object of the invention to enhance the utility of sound-emitting display signs such as point of purchase or sale advertising display boards. It is a further object of the invention to provide an inexpensive and even disposable drive unit, which may be self-contained, for loudspeakers in objects such as toys, novelties and merchandising, such as point of sale or point of purchase advertising display boards.

According to the invention there is provided a drive module for attachment to a rigid panel and adapted to apply bending wave energy at audio frequencies to the panel whereby the panel can radiate an audio output. The drive module comprises a housing adapted to be secured to the panel, at least one foot on the housing and adapted to fix the housing securely to the panel, an electro-mechanical transducer in the housing, a support for the transducer in the housing, the transducer being adapted to contact the panel to apply bending wave energy thereto when energised with an electrical audio signal, and an audio signal amplifier in the housing.

When attached to a rigid panel the drive module thus forms a loudspeaker.

The foot may be providing with one or more pressure sensitive adhesive pads to fix the housing to the panel. The foot structure may be continuous or may comprise a plurality of spaced feet.

The transducer may be piezoelectric or of the magnet and coil variety. The transducer may be inertial, in which case it is compliantly mounted on the housing, or may be grounded on the housing. The transducer may be adhesively fixed to the panel. Thus where the transducer is an electrodynamic device, it may be compliantly mounted, via its magnet to the housing, and may be adhesively fixed, e.g. via a pressure sensitive panel and via its voice coil to the panel.

Preferably the mounting of the housing on the panel is compliant. Thus the portion(s) of the housing in the region of the pressure sensitive adhesive may be resilient. This can be achieved by forming the housing with peripheral inwardly directed resilient flanges to form the foot or feet.

The audio signal amplifier may be resiliently mounted in the housing.

The housing may be perforated to allow audio energy from the panel to pass through the housing.

The housing may carry one or more electric dry cell batteries to power the signal amplifier. These batteries may be substantially symmetrically disposed around the transducer to help equalise force distribution on the transducer suspension.

BRIEF DESCRIPTION OF THE DRAWING

Examples that embody the best mode for carrying out the invention are described in detail below and are diagrammatically illustrated in the accompanying drawing, in which.

DETAILED DESCRIPTION

Figure 1A:
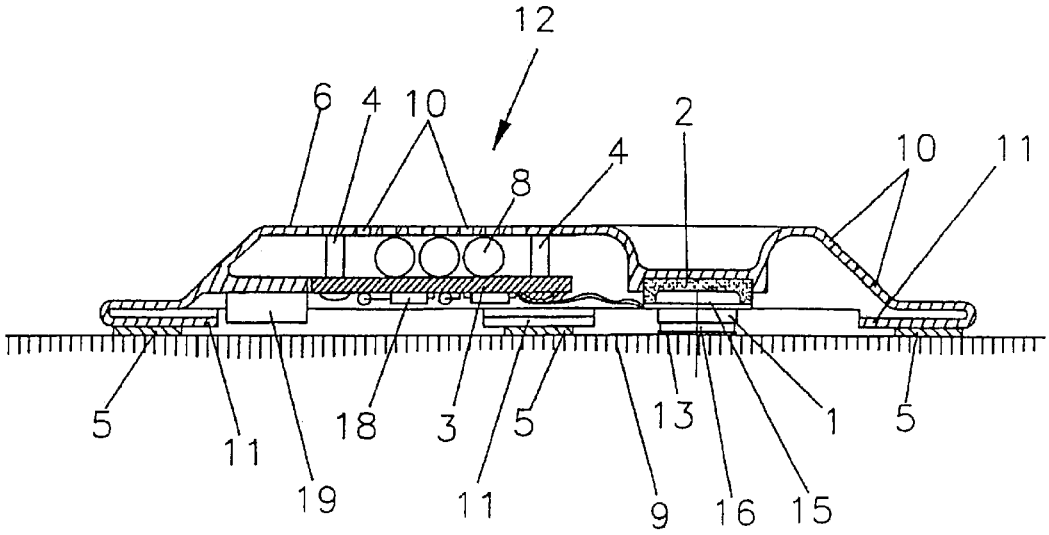
FIG. 1*a* is a cross-sectional side elevational view of a first embodiment of a drive module according to the invention for converting a display board to produce an audio output.

In FIG. 1*a* there is shown a drive module (12), e.g. for converting a rigid panel in the form of a display board (9), e.g. a point of purchase advertising display which is normally made of cardboard or the like rigid lightweight material, to provide an audio output to enhance the display.

The module (12) comprises a housing (6) in the form of an dished member, e.g. of a rigid plastics, formed with feet in the form of a plurality of spaced peripheral inwardly turned resilient flanges (11) carrying pressure sensitive adhesive pads (5) whereby the housing can be firmly affixed to a face of the display board (9), with the flanges (11) providing a compliant suspension of the housing (6) on the panel (9).

The housing (6) carries an electro-acoustic transducer (1) of the inertial kind comprising a magnet assembly (15) and a voice coil assembly (16). FIG. 5C of Azima U.S. Pat. No. 6,192,136 (incorporated herein by reference) shows just one example of a suitable transducer. The transducer is coupled to the housing (6) by a resilient suspension (2) and the voice coil assembly is rigidly fixed to the board (9) by a pressure sensitive adhesive pad (13). In this way the transducer can apply bending wave energy to the board (9) to cause it to radiate an acoustic output. The resilient or compliant mounting of the housing on the board is to prevent the housing from hindering the propagation of bending wave energy and to help prevent unwanted or unintended vibration of the housing. Thus the housing may also provide damping or mass loading to improve the performance of the panel.

The housing (6) carries signal amplifying electronics (18), e.g. a PWA or pulse width amplifier, mounted on a printed circuit board (3), and electric batteries (8) for powering the power amplifier. The printed circuit board (3) is mounted on a compliant mounting (4) in the housing. The module housing (6) also carries an audio signal storage device (19) connected to the audio amplifier electronics (18). The audio signal storage device may, for example, be a tape player or compact disc player or the like.

Figure 1B:
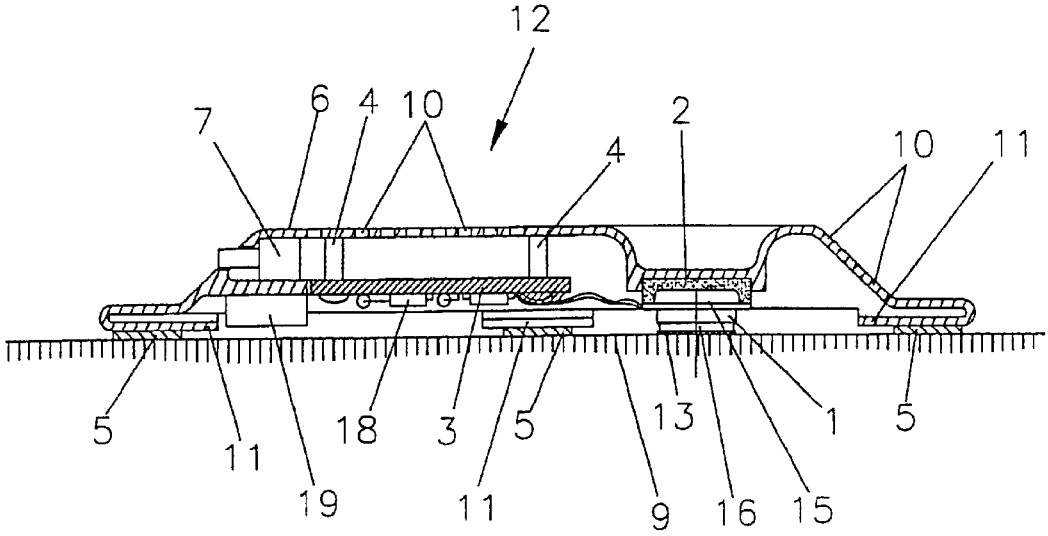
FIG. 1*b* is a view similar to FIG. 1*a* showing a modification of the drive module.

The housing (6) is formed with apertures (10) to allow acoustic energy from the board (9) to pass, substantially unimpeded, through the housing. The printed circuit board (3) on which the electronics (18) are mounted may similarly be apertured for the same purpose. As shown in FIG. 1*b*, power supply connectors (7) to the amplifier (13) can be provided as an alternative to the use of internal batteries.

Figure 2:
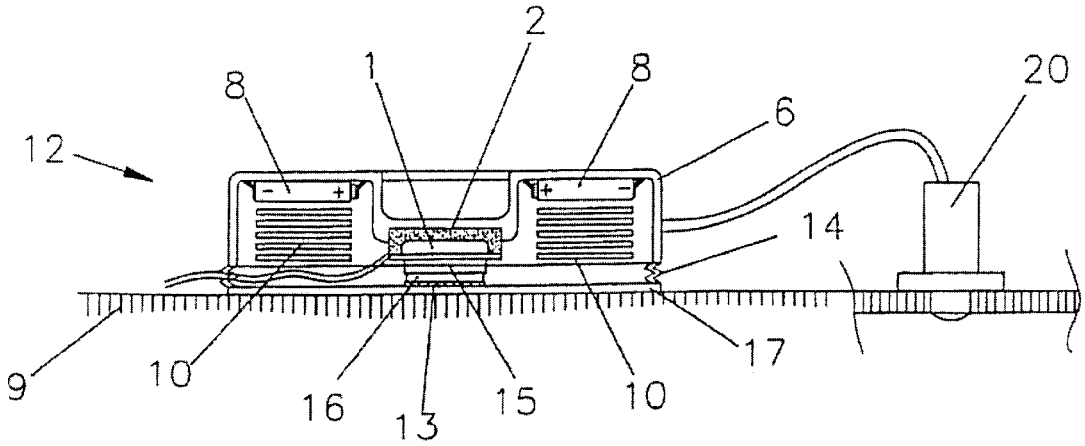
FIG. 2 is a cross-sectional side elevational view of a second embodiment of a drive module according to the invention.

In FIG. 2 there is shown a drive module (12) generally of the kind shown in FIG. 1*a* for application to a display board (9) to convert the display board into a loudspeaker. In this embodiment the module housing (6) is mounted to the display board (9) by a self adhesive (21) provided on a foot in the form of a peripheral plinth (17) with a corrugated resilient suspension (14) connected between the plinth (17) and the housing (6). The batteries (8) in the housing are equally disposed about the transducer (1) to assist in equalising force distribution on the transducer suspension. The module incorporates an external sensor (20) fixed to the board (9) at any convenient location, to allow the assembly to respond to proximity or voice input from a passer-by, e.g. the sensor being in the form of a PIR or passive infra red movement detector, a photocell, or a sensing microphone.

Inboard electronics, memory and signal processing for storing, receiving, selecting and decoding audio data may be provided in the module.

The amplifier to supply audio power to the exciter may, for example, be from 0.1 W to 10 W in output, and is preferably of good efficiency to reduce the need for a bulky heatsink, e.g. it may use digital or switching technology if of higher power, say above 1 W.

The module may include control circuitry, e.g. to adjust level or the data channel.

The processor may have a data input to receive audio data/programme.

A lamp or LED or form or data display, e.g. visual or complementary readout of the audio data, may be included to show operational states or to convey additional information, and this may be directed through an aperture in the display board or panel or by the choice of a part or wholly translucent or transparent display panel.

The display board or panel used with module may be advantageously be of distributed mode principle/design to further maximise sound quality e.g. as described in WO97/09842 and U.S. Ser. No. 08/707,012.

The module may be designed to have adhesive surfaces exposed by peel-off covers for both the module and the exciter coupling to the panel for rapid, non skilled assembly of the complete speaker/sound reproducing system.

The module may be designed to be dust/splash proof or waterproof with a continuous adhesive sealing around its perimeter.

The invention thus provides a convenient and self contained module for increasing the functionality of display boards and the like, as well as providing a self contained speaker driver for other rigid panels in toys, novelties, and merchandising generally.

What is claimed is:

1. A drive module adapted for attachment to any rigid panel and adapted to apply bending wave energy at audio frequencies to the panel whereby the panel can radiate an audio output, comprising a housing adapted to be secured to the panel, at least one foot on the housing, at least one pressure-sensitive adhesive pad on said at least one foot adapted to fix the housing securely to the panel, an electromechanical transducer in the housing, a support for the transducer in the housing, a pressure-sensitive adhesive pad on the transducer adapted to couple the transducer to the panel whereby the transducer can apply bending wave energy to the panel when energised with an electrical audio signal, and an audio signal amplifier in the housing.

2. A drive module according to claim 1, wherein said at least one foot comprises a plurality of spaced feet.

3. A drive module according to claim 2, wherein each of said feet is provided with a pressure sensitive adhesive pad to fix the housing to the panel.

4. A drive module according to claim 1, wherein said at least one foot comprises a peripheral plinth.

5. A drive module according to claim 4, wherein said at least one pressure sensitive adhesive pad is on said peripheral plinth.

6. A drive module according to claim 1, wherein the transducer is of the magnet and coil variety.

7. A drive module according to claim 1, wherein the audio signal amplifier is resiliently mounted in the housing.

8. A drive module according to claim 1, wherein the housing is perforated to allow audio energy from the panel to pass through the housing.

9. A drive module according to claim 1, wherein the housing carries at least one electric dry cell battery to power the signal amplifier.

10. A drive module according to claim 9, comprising a plurality of batteries which are substantially symmetrically disposed around the transducer.

11. A drive module according to claim 1, comprising an audio signal storage device connected to the audio signal amplifier.

12. A drive module according to claim 1, comprising a motion or proximity sensor adapted to activate the audio signal amplifier.

13. A drive module according to claim 6, wherein the transducer is inertial, and is compliantly mounted in the housing.

14. A drive module according to claim 13, wherein the portion(s) of the housing in the region(s) of said at least one foot are resilient.

15. A drive module according to claim 14, wherein the housing is formed with peripheral inwardly directed resilient flanges to form said at least one foot.

16. A drive module according to claim 13, wherein the mounting of the housing on the panel is compliant.

17. A drive module according to claim 16, wherein the portion(s) of the housing in the region(s) of said at least one foot are resilient.

18. A drive module according to claim 17, wherein the housing is formed with peripheral inwardly directed resilient flanges to form said at least one foot.

19. A bending wave loudspeaker comprising a rigid panel and a drive module attached to the panel and adapted to apply bending wave energy at audio frequencies to the panel whereby the panel can radiate an audio output, wherein the drive module comprises a housing, at least one foot on the housing, at least one pressure-sensitive adhesive pad on said at least one foot, an electromechanical transducer in the housing, a support for the transducer in the housing, a pressure-sensitive adhesive pad on the transducer, and an audio signal amplifier in the housing, and wherein the housing of the drive module is secured to the panel by said at least one pressure-sensitive adhesive pad on said at least one foot, and the transducer is coupled to the panel by said pressure-sensitive adhesive pad on the transducer whereby the transducer can apply bending wave energy to the panel when energised with an electrical audio signal.

20. A bending wave loudspeaker according to claim 19, wherein said at least one foot comprises a plurality of spaced feet.

21. A bending wave loudspeaker according to claim 20, wherein each of said feet is provided with a pressure sensitive adhesive pad to fix the housing to the panel.

22. A bending wave loudspeaker according to claim 19, wherein said at least one foot comprises a peripheral plinth.

23. A bending wave loudspeaker according to claim 22, wherein said at least one pressure sensitive adhesive pad is on said peripheral plinth.

24. A bending wave loudspeaker according to claim 19, wherein the transducer is of the magnet and coil variety.

25. A bending wave loudspeaker according to claim 24, wherein the transducer is inertial, and is compliantly mounted in the housing.

26. A bending wave loudspeaker according to claim 25, wherein the portion(s) of the housing in the region(s) of said at least one foot are resilient.

27. A bending wave loudspeaker according to claim 26, wherein the housing is formed with peripheral inwardly directed resilient flanges to form said at least one foot.

28. A bending wave loudspeaker according to claim 25, wherein the mounting of the housing on the panel is compliant.

29. A bending wave loudspeaker according to claim 28, wherein the portion(s) of the housing in the region(s) of said at least one foot are resilient.

30. A bending wave loudspeaker according to claim 29, wherein the housing is formed with peripheral inwardly directed resilient flanges to form said least one foot.

31. A bending wave loudspeaker according to claim 19, wherein the audio signal amplifier is resiliently mounted in the housing.

32. A bending wave loudspeaker according to claim 19, wherein the housing is perforated to allow audio energy from the panel to pass through the housing.

33. A bending wave loudspeaker according to claim 19, wherein the housing carries at least one electric dry cell battery to power the signal amplifier.

34. A bending wave loudspeaker according to claim 33, comprising a plurality of batteries which are substantially symmetrically disposed around the transducer.

35. A bending wave loudspeaker according to claim 19, comprising an audio signal storage device connected to the audio signal amplifier.

36. A bending wave loudspeaker according to claim 19, comprising a motion or proximity sensor adapted to activate the audio signal amplifier.

* * * * *